US005771643A

United States Patent [19]

Parker

[11] Patent Number: 5,771,643

[45] Date of Patent: Jun. 30, 1998

[54] CONCRETE SLAB-WALL SPACER WITH WATER AND RADON REMOVAL FEATURES

[76] Inventor: Alton F. Parker, 8 Hiawatha Dr., Clifton Park, N.Y. 12065

[21] Appl. No.: 437,981

[22] Filed: May 10, 1995

[51] Int. Cl.[6] ..... E02D 19/00

[52] U.S. Cl. ..... 52/169.5; 52/169.14; 52/302.1; 404/8; 405/45; 405/50

[58] Field of Search ..... 52/169.5, 169.8, 52/302.3, 302.1, 169.14; 404/8; 605/45, 50

[56] References Cited

U.S. PATENT DOCUMENTS

| | | | |
|---|---|---|---|
| 3,283,460 | 11/1966 | Patrick | 52/169 |
| 3,850,193 | 11/1974 | Guzzo | 52/169.5 X |
| 3,979,860 | 9/1976 | Roth et al. | 52/302.1 X |
| 4,245,443 | 1/1981 | Beecher | 52/169.5 |
| 4,745,716 | 5/1988 | Kuypers | 52/169.5 |
| 4,757,651 | 7/1988 | Crites | 52/169.5 |
| 4,798,034 | 1/1989 | Jarnagin et al. | 52/169.5 |
| 4,869,032 | 9/1989 | Geske | 52/169.5 |
| 4,907,385 | 3/1990 | Biodrowski | 52/169.5 |
| 4,907,386 | 3/1990 | Kroth | 52/169.1 X |
| 5,044,821 | 9/1991 | Johnsen | 52/169.5 X |
| 5,054,252 | 10/1991 | Newman | 52/169.14 |
| 5,289,664 | 3/1994 | Rizza et al. | 52/302.1 |
| 5,501,044 | 3/1996 | Janesky | 52/169.5 |

*Primary Examiner*—Carl D. Friedman
*Assistant Examiner*—Winnie S. Yip
*Attorney, Agent, or Firm*—Schmeiser, Olsen & Watts

[57] ABSTRACT

A concrete slab and wall spacer with water and radon removal elements. The invention includes a cross-sectionally, L-shaped elongate strip of semi-rigid, nonbio-degradable material. At least halfway up the entire elongate vertical leg of the L-shape is a horizontally disposed pro-jection which is integral with the strip. The spacer projection is placed against a wall, the L base resting on a portion of the footing subtended by the wall in a conventional spacer usage. The underside of the base of the L is generally relieved in order to allow transmigration of water and gaseous substances. Several applications for the strip are disclosed, one being the sealing of the shelf to the abutting wall with placement of a gas impermeable membrane in an overlapping arrangement with the L base so as to form, relative to the strip and the abutted wall, an upper fluid region and a lower gas region. The gas region is vented by a conduit which penetrates the projection, while the water in the upper liquid region is removed by other conventional methods, conceivably by through-the-wall conduits or a sump region built into or adjacent the footing.

21 Claims, 2 Drawing Sheets

CONCRETE SLAB-WALL SPACER WITH WATER AND RADON REMOVAL FEATURES

BACKGROUND OF THE INVENTION

1. Field of the Invention

This invention relates generally to a form, having stand-off character, for use in separating a concrete slab from peripheral wall structures and, particularly, to a combination water removal and radon venting apparatus that provides the aforesaid slab stand-off feature.

2. Relevant Art

Concrete slabs, mostly in basements and subterranean structures, are generally constructed to be set apart from surrounding walls. They rest on well-drained soil/gravel matrices and are colloquially termed to "float". Many devices have been created in order to construct the walls and, subsequently, the slabs so that the latter features this floating character, the character having been acquired through use of a concrete form, either temporary or permanently installed, that allows a separation to exist between the peripheral walls and the curing slab. Stand-offs or separators which impart this characteristic to a wall-slab complex have existed for years and, in the past two decades, have been augmented with features or options that enhance the drainage of water which may accumulate on the slab or seep from the walls to the wall-slab interface. Patents relevant to this slab spacer and water drainage conception are: U.S. Pat. Nos. 4,869,032 ('032); 4,757,651 ('651); 3,283,460 ('460); 4,745,716 ('716); and, 4,245,443 ('443).

An apparatus and method for waterproofing basements is disclosed in '032, which teaches a device of elongate form having a vertical leg joined to an orthogonal horizontal leg. In cross-section, the device resembles a stylized L-shape with the top margins of the vertical leg reflexing away from the horizontal leg. The vertical leg is periodically vented, while the horizontal leg, as well as portions of the vertical leg, has a series of integral conduits or elongate detents which may be characterized as corrugations. It is the purpose of the device, additional to acting as a spacer or stand-off form to acquire separation between a concrete slab and the adjacent wall, to provide a path from the wall face and wall-footing juncture over the footing to an adjacent gravel bed which is drained by a porous or foraminous drainage conduit. This facility (of water drainage) combined with a slab-wall separator form is characteristic of all of the art, including the instant invention, to be hereinafter discussed.

Patent '651 discloses a wall system for use on a vertical wall, such as a basement wall. A drain conduit is positioned adjacent the wall footing and a collection member is mounted along the bottom of the wall. The collection member is a stand off of rigid construction which has reflexed top and bottom margins to acquire the stand-off facility and collect water from the wall-footing juncture. The collection member is further manifolded, by a plurality of drainage lines, to a large drain conduit that is subtended by the slab and wall-footing juncture and receives the drainage waters from the collection member.

An L-shaped means for damp proofing basements is disclosed in Patent '460 and features an essentially solid device having, on the outside surfaces of the L, a plurality of vertical grooves communicating with a plurality of horizontal grooves. Thus, additional to its stand-off feature, which affords a spacing between the wall and the concrete slab, the disclosed device is conducive to the channeling of water seepage from the wall and footing towards the adjacent, and otherwise conventional, footing drain. The structural wall control device of Patent '716, though of clearly different design than '460, nevertheless embodies the same precepts and functions in the same manner. Details or options are added such as an alignment strip which allows a user to level the floor by using a string and chalk, or other conventional means, to mark the desired level on the alignment strip so that the concrete can be poured to the desired level and not overflow into the vertical corrugations which are to act as drains.

The last in the series of relevant art patents, Patent '443, teaches a seepage control device that has the usual L-shape cross-section in which the vertical member or component includes a series of corrugations; the horizontal component features a similar plurality of corrugations or channels. In this embodiment, the inner portions of the L-shape are smooth and flat, that is, the relief of the corrugations is on the outside of the vertical and horizontal surfaces only. This allows the shape of the slab to effect straight, smooth margins. Further, the '443 device, like the '615 device, employs a plurality or series of nails, studs or bolts to affix the inner face of the vertical member directly to the wall. All of the other relevant art patents appear to have no means for fastening the device to the wall or the footing.

Modern construction has gone beyond the decades-old requirements for slab separation and water drainage. Today, modern construction has seen the demand for sub-slab radon removal, as well as the fulfillment of the older requirements. Current radon removal techniques generally embody the placement, below the slab, of a radon scavenging network. It generally includes a radon venting network beneath the slab and adjacent the footings and is vented, proximate the wall surfaces, to atmosphere. To ensure that radon does not penetrate cracks in the slab, a gas-impermeable barrier is generally set between the slab subsurface and the slab. Thus, in addition to being drained by whatever water venting means is used, the radon scavenging network performs its function additional to, and isolated from, the slab separation and water removal functions. This bifurcation, and often trifurcation, of functions and facilities is expensive in terms of supplies and extremely time consuming in their piecemeal installation. With the increasing cost of materials and supplies, as well as those of labor, it is clearly evident that a demand exists for a more reasonable and economical solution.

3. Incorporation by Reference

Being relevant to this disclosure, the following patents are hereinafter incorporated by reference: U.S. Pat. Nos. 4,869,032, 4,757,651, 3,283,460, 4,745,716, and 4,245,443.

SUMMARY OF THE INVENTION

The instant invention answers the aforementioned need for acquiring, in a singular device, the spacer with water and radon removal features. Essentially a water seepage control device for draining the floor slab and the slab perimeter walls, it includes an L-shaped strip of semi-rigid, nonbiodegradable material that has a vertical portion running conterminously with an orthogonally disposed horizontal portion. In the preferred embodiment, surfaces characterizing the internal angle of the L-shaped device are flat or planar and without relief. At least halfway up the outside of the vertical portion is an integral ledge or shelf projection that provides the actual stand-off character of the L-shaped form. In a preferred embodiment, the bottom or outside surface of the horizontal (base) portion may be relieved by grooves, corrugations, hobnail effect or any other form of (networking) relief that would allow water to seep under the form, as well as radon gas to transpire in the opposite direction. Maintaining this communication aspect is a plurality or series of grooves, cuts or notches running vertically and periodically through the shelf/ledge member. Additionally, several options, in the way of accessories or features, are available for usage with the preferred embodiment and serve as enhancements to the installation of the preferred embodiment when it is to specifically incorporate water removal and/or radon venting features.

One such option employs the preferred embodiment without a notched or grooved stand-off shelf. The form is placed against a wall-footing juncture with the interior angle pointing outward and the shelf/ledge against the wall. Venting holes are provided at strategic positions along the wall and a conduit is snugly fitted into each of the vents. The shelf-wall juncture is sealed with a caulk that, like the invention, is water impervious, nonbiodegradable and has adhesive qualities allowing it to act as a sealant between the wall and the shelf. Thus, the shelf forms a line of demarcation between an upper portion of the invention called a liquid region and a lower portion between the wall and the invention, termed a gaseous region. With the placement of a radon gas barrier over/under the horizontal portion or base of the invention such that it effectively is conterminous with the (wall) peripherally installed invention, the sub-slab, sub gas barrier region is vented of radon. Radon moves from under the barrier, under the relieved surface of the invention's horizontal (base) portion into the gaseous region that is demarcated by the shelf and sealant bead, and therefrom vented through one of the vertically installed conduits by means (such as exhaust pump) that are known in the building trades. Additional options or enhancements that are acquired with the preferred embodiment consist of, in one instance, the aforementioned relieved bottom of a horizontal portion of the invention. Yet another optional feature includes a flexible ribbonous flap-like addition that is secured to the base member conterminous the interior angle of the L-shaped form. This flap is liftable, to form a pocket, and allows insertion of the radon gas barrier membrane between it and the base upper surface. For economy's sake, this flap option may be dispensed with and ordinary adhesive, such as roofing cement of any number of the adhesives used in modern construction, may be smeared on the installed invention over the upper surface of the base in order to adhere the margins of the radon gas barrier thereto. Alternatively, the barrier may be placed between the base and the footing and the invention nailed to the footing.

The size of the invention is not of particular concern save that the height of the vertical portion must be sufficient to ensure that the slab concrete, when poured, will not spill over onto the stand-off ledge of the invention, especially if it is installed in the preferred embodiment having vertical grooves or notches through the ledge, as aforementioned. The base may be of a length suitable for stabilizing the invention on a footing or, in cases where permanently installed form-drain members are used, the base may be extended to a portion of that form-drain member and secured to the upper surface thereof. In cases where the invention projects above the slab surface, and it is desirable to maintain some slab surface drainage, portal areas may be readily cut out of the vertical portion of the invention flush with the existing slab. Provision of knockout points along the upper margin of the slab would appear useful; however, such would constitute an uneconomical adjunct. A small reciprocating saw, or similar device, could be used to readily create a number of such ports if they were required. In cases where the zonal separation of liquid and gaseous substances are defined, it makes no difference that the slab is raised to the uppermost margin of the invention, since no vertical grooves or notches are present in the shelf of the invention. Since the invention is to be a semi-rigid, nonbiodegradable element, a great number of materials may be used to realize the physical embodiment. The most economical to produce are extruded or formed plastics such as polyvinyl chloride (PVC) or high-density polyethylene. Other materials such as asphalt impregnated fibrous boards or fiber glass will also suffice. Material selection, the same as options aforementioned, may be selected at the discretion of the manufacturer or the user of the invention.

DETAILED DESCRIPTION OF THE PREFERRED EMBODIMENT

Figure 2:
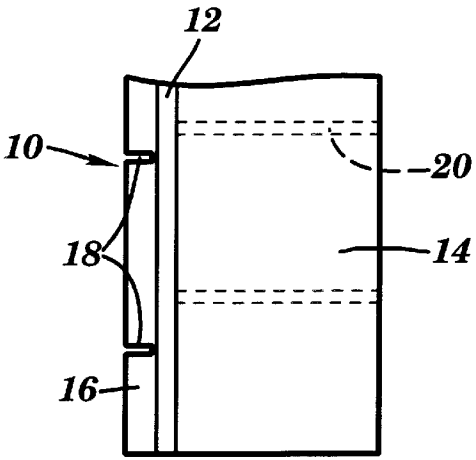
FIG. 2 is a top plan of the invention.
Figure 1:
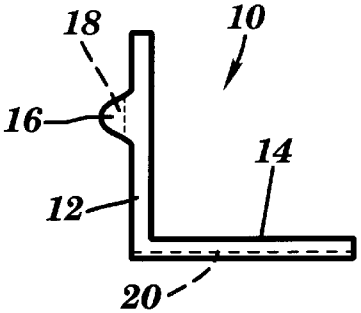
FIG. 1 is a side elevation of the invention.

Referring to FIG. 1, a side elevation of the invention 10 discloses the L-shape form with the vertical portion 12 being orthogonally disposed with respect to, and conterminous with, the horizontal portion 14. Projecting from the backside of the vertical portion 12 is a detent, ledge or shelf 16, which is preferredly a cantilevered ledge, disclosing the (invisible) vertical slots 18 that are periodically located in the shelf. Other features, comprising options to the preferred embodiment, are the additional thickness which includes grooves 20, corrugations or other venting means in the horizontal portion 14 (hereinafter termed base). FIG. 2 is a top plan of the FIG. 1 embodiment and discloses the features previously discussed.

Figure 3:
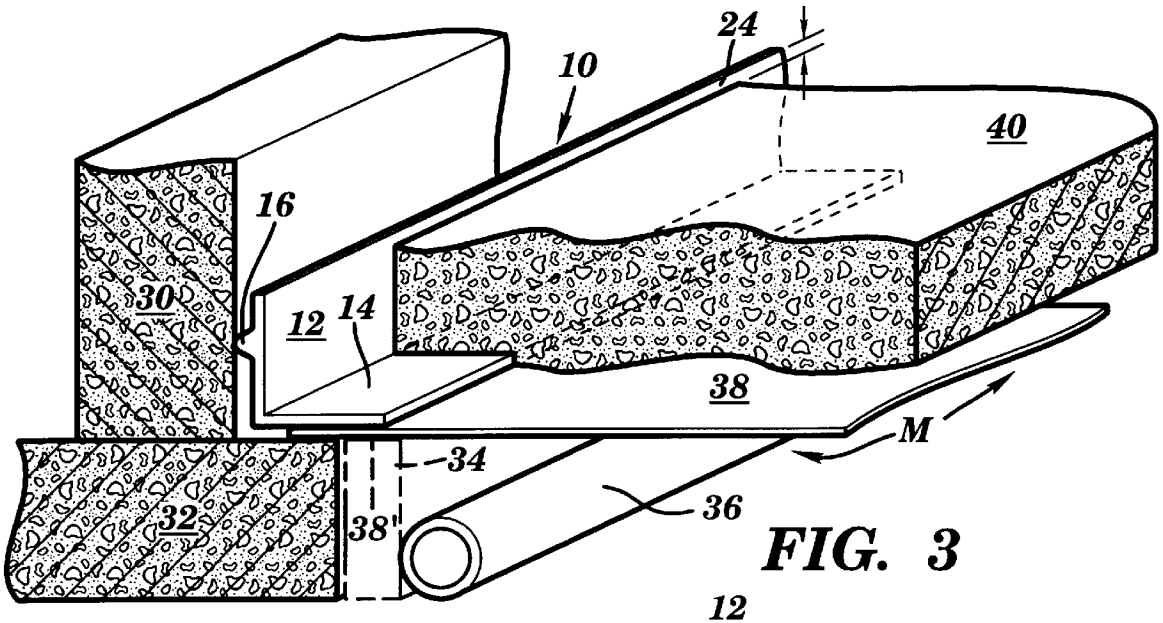
FIG. 3 is an illustration of the invention installed in conventional wall-slab separation posture.

FIG. 3 shows the invention 10 in an installed mode conforming to a wall 30 on footing 32 construct. The shelf 16 is shown in abutment with the wall 30 while the base of the invention 10 rests on the footing 32 with a notable overhang onto permanently installed footing form 34. Thus, the FIG. 1 embodiment may be nailed base-to-footing or base-to-form 34, as the installer desires. Whether alongside the footing 32 or a permanently installed form 34, drain tile 36 is the conduit for removing any water passing down the wall 30, over the footing 32 and under the invention 10 into the soil and gravel matrix M, which serves as the foundation for the slab 40. Interposed the slab 40 and the matrix M is the impermeable radon gas barrier 38. The barrier 38 is generally a membrane or film made of commonly available polyethylene plastic and is installed over the matrix M and onto the footing 32. When using the invention, however, the barrier 38 overlaps a portion (above, or below 38') or all of base 14. Lastly, in FIG. 3 there is disclosed the extension 24 of the vertical portion 12 of the invention. As shown by the opposing arrows (immediately below 24), the extension may be cut off in certain areas after the slab 40 cures. However, in the figure description that follows, a special liquid-gas separation option obviates the need to maintain the slab top surface below the upper margin of the vertical portion 12.

The extension 24 is, nonetheless, shown in that figure (FIG. 4) for illustration purposes only.

Figure 4:
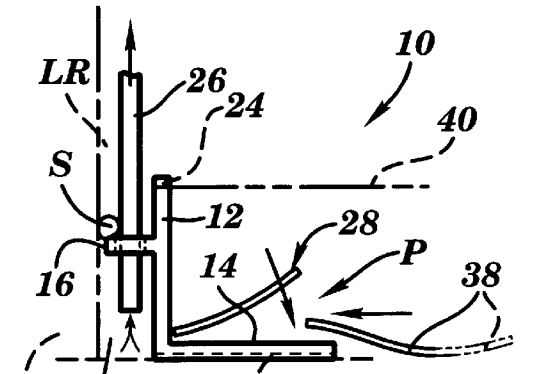
FIG. 4 is a side elevation of the invention with selected options.
Figure 5:
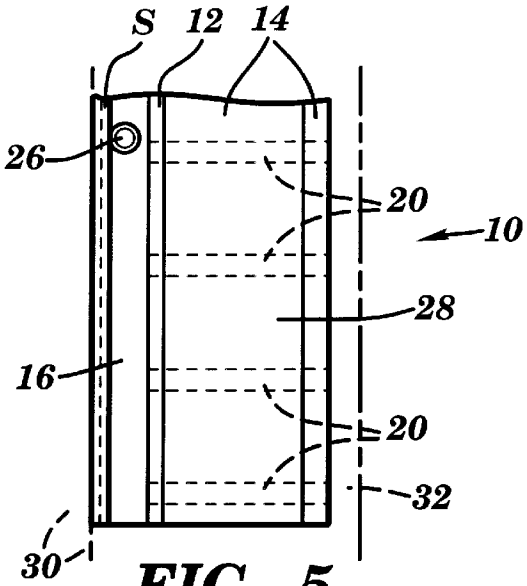
FIG. 5 is a top plan of the FIG. 4 embodiment.

Referring now to FIG. 4, the preferred embodiment of the invention 10 is shown with elements bearing the same nomenclature as in FIGS. 1 and 2. Additionally, the shelf 16, seen almost abutting the wall 30, is adhesively sealed therewith by an adhesive, water impermeable and nonbiodegradable sealant S. This construction demarcates the area between the wall 30 and the invention 10 into an upper liquid region LR and a lower, gas region GR, the latter gas region being ventable through conduit 26 of which more than one may exist in any completed installation. The venting is accomplished by means (such as an exhaust pump) that are known in the building trades. The liquid region is drained by means for evacuating water (such as a sump pump or a siphon). Another unique feature to this figure is the use of flap 28 which is sealed at a margin conterminous with the interior angle of L shape, that is the conterminous juncture of the vertical portion 12 and the base 14 of the invention. This flexible flap 28 forms a pocket P into which the barrier 38 may be inserted as shown. The pocket or other capturing means for holding the barrier and preventing the radon gas from diffusing into the area above the slab should hold the gas barrier in such a manner that communication between the gravel matrix and the gas region GR is permitted. A reference to FIG. 5 discloses a top plan of the FIG. 4 embodiment except for the slab 40 and pocket P definition.

Figure 7:
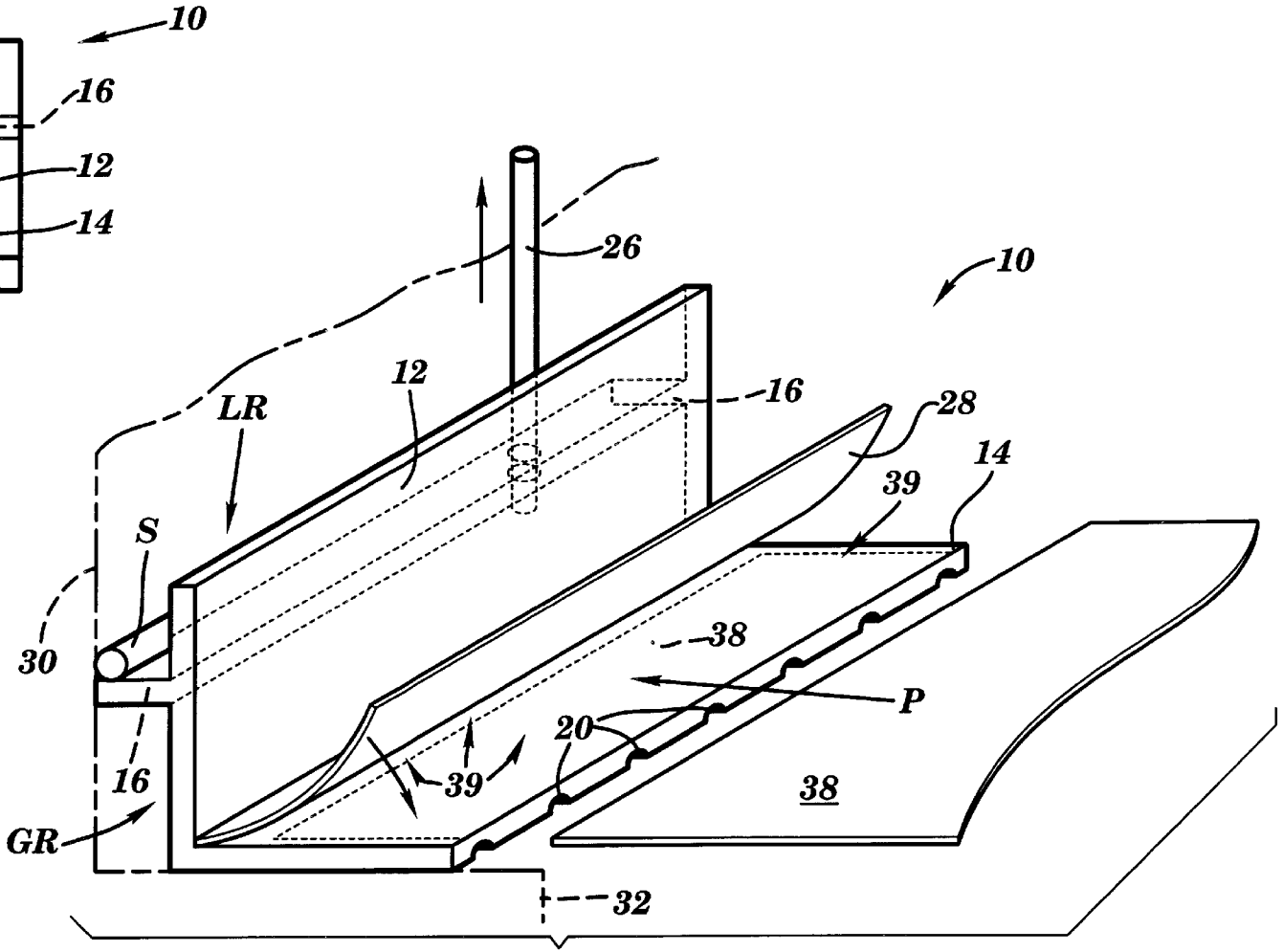
FIG. 7 is an isometric illustration of the FIGS. 4 and 5 embodiment of the invention.
Figure 6:
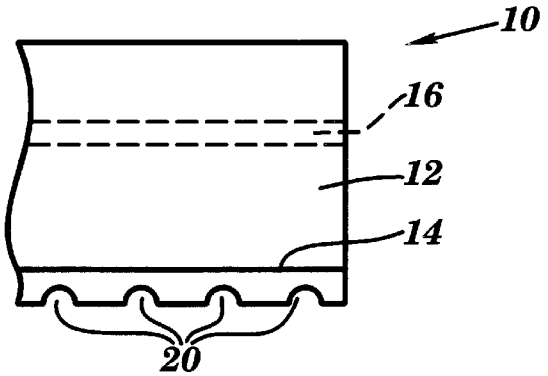
FIG. 6 is a frontal elevation of the invention.

Referring to both FIGS. 6 and 7, the former being a frontal elevation of my invention and the latter an isometric illustration of the FIG. 4 embodiment, a clearer picture is afforded the reader. Although FIG. 1 discloses a preferred embodiment, such refers only to the invention itself. From the point of view earlier expressed, that is, an economical device affording all of the modern, desired attributes of water and radon removal, the FIG. 7 embodiment, absent perhaps the flap 28, would be the most in demand. As mentioned earlier and as regarding FIG. 7, the flap 28 may be dispensed with and in lieu thereof ordinary mastic or adhesive, as is common throughout the industry, may be used to adhere barrier 38 to the upper surface of the base 14 approximately in the area denoted by the dash lines 39.

Those of ordinary skill will realize that many modifications may be made to the instant invention, the embodiments and options described herein, without departing from the scope or spirit of the following appended claims.

What is claimed is:

1. A water seepage control device with radon scavenging aid means comprising:

a semi-rigid, nonbiodegradable strip bent lengthwise into an L-shape and having a shelf means projecting orthogonally from a backside of a vertical portion of the strip away from and essentially parallel a base of the strip such that the shelf means partitions the vertical portion into an upper channel and a lower chamber when said shelf means is disposed against a wall and while an underside of the base rests on a footing that supports the wall;

a sealing means for closing any spacing between the shelf means and the wall; and a fluid communication means disposed on said underside of the base for effecting a fluid scavenging between the chamber and the underside of the base, and a conduit means penetrating said shelf means from said outside of said lower chamber, wherein said lower chamber, said shelf means, said sealing means, said communication means, and said conduit means proving said radon scavenging aid means.

2. The device of claim 1 wherein said radon scavenging aid means further comprises a vapor barrier fabric secured to a surface of the base by a capturing means, whereby an area under said fabric communicates through said communication means with the clamber.

3. The device of claim 1 wherein said sealing means is a water impervious adhesive caulk.

4. The device of claim 2 wherein said capturing means is a pocket means which is cojoined to the base.

5. In a water removal system for floating slabs comprising, in combination:

a slab perimeter wall having an interior face;

a footing, upon which the slab perimeter wall rests;

a water seepage control device, resting on the footing; and a floor slab being disposed on the water seepage control device, an improvement of said water seepage control device comprising:

a cross-sectionally L-shaped strip of semi-rigid, nonbiodegradable material having a vertical portion disposed orthogonally with respect to a conterminous horizontal portion, said strip projecting an integral shelf means at least halfway up the vertical portion opposite and lying in a plane essentially parallel to the horizontal portion, said strip further including a liftable flap to attach a gas impermeable barrier to the strip extending substantially parallel to the horizontal portion.

6. 3. A slab-wall spacer positionable between a floor slab and a slab perimeter wall having a footing, the slab-wall spacer comprising:

an L-shaped strip of semi-rigid, nonbiodegradable material having a vertical portion integrally and orthogonally disposed with respect to a horizontal portion;

a shelf extending from at least halfway up the vertical portion in the opposite direction than the horizontal portion, the shelf adapted to nearly abut the slab perimeter wall to form a chamber between the shelf, footing and slab perimeter wall; and at least one conduit extending through at least one vertical slot in the shelf for fluid communication with the chamber.

7. The spacer of claim 6, further including means for attaching a gas impermeable barrier to the strip.

8. The spacer of claim 7, wherein the means for attaching is an adhesive.

9. The spacer of claim 7, wherein the means for attaching is a liftable flap coextensive with and disposed on the horizontal portion.

10. The spacer of claim 6, wherein the horizontal portion adapted to rest upon the footing, the horizontal portion including a plurality of corrugations in a bottom surface thereof to form channels between the footing and the horizontal portion.

11. The spacer of claim 6, wherein the shelf is adapted to be sealed to the slab perimeter wall by a water impermeable sealant.

12. A water seepage control device for draining a floor slab and slab perimeter wall comprising in combination:

a slab perimeter wall, having an interior face;

a footing, upon which the slab perimeter wall rests;

a floor slab;

a cross-sectionally L-shaped strip of semi-rigid, nonbiodegradable material, the strip including:

a vertical portion disposed orthogonally with respect to a conterminous horizontal portion, the horizontal portion being on the footing and the floor slab resting on the horizontal portion, an integral shelf extending from at least halfway up the vertical portion in a direction opposite to the horizontal portion, the integral shelf extending toward the interior face of the slab perimeter wall to form a chamber defined by the vertical portion, the footing and the interior face of the slab perimeter wall, the shelf also including at least one vertical slot extending therethrough; and a conduit extending from the chamber through each slot for scavenging radon form said chamber.

13. The device of claim 12 further comprising a gas impermeable membrane between said horizontal portion and said footing.

14. The device of claim 12 wherein said horizontal portion further comprises venting means on an underside thereof, said venting means disposed essentially orthogonal to said vertical portion.

15. The device of claim 14 wherein said venting means is an array of grooves.

16. The device of claim 14 wherein said venting means is a corrugated surface.

17. The device of claim 14 wherein said venting means is a relief pattern on said underside.

18. The device of claim 12, wherein a sealant is interposed the shelf and the slab perimeter wall to seal the strip against the slab perimeter wall.

19. A slab-wall spacer positionable between a floor slab and a slab perimeter wall having a footing, the slab-wall spacer comprising:

an L-shaped strip of semi-rigid, nonbiodegradable material having a vertical portion integrally and orthogonally disposed with respect to a horizontal portion; and a liftable flap extending substantially parallel to the horizontal portion for attaching a gas impermeable barrier to the strip.

20. A radon barrier system for use between a floor slab and a slab perimeter wall having a footing, the radon barrier system comprising:

an elongated L-shaped strip of nonbiodegradable material having a vertical portion integrally and orthogonally disposed with respect to a horizontal portion;

a shelf extending from and along the length of the vertical portion in a direction opposite the horizontal portion, the shelf adapted to nearly abut a slab perimeter wall; and a plurality of grooves provided in a bottom surface of the horizontal portion, the bottom surface being adapted to rest upon a footing and a radon barrier attached to said horizontal portion of said L-shaped strip.

21. The system of claim 20, wherein the grooves extend orthogonally to the vertical portion.

* * * * *